US005232150A

United States Patent [19]

Solomons

[11] Patent Number: 5,232,150

[45] Date of Patent: Aug. 3, 1993

[54] TWO WAY ENVELOPE FOR AUTOMATED INITIAL USE

[76] Inventor: Charles Solomons, 19 Eastlake Dr., Thiells, N.Y. 10984

[21] Appl. No.: 926,462

[22] Filed: Aug. 7, 1992

[51] Int. Cl.[5] ..... B65D 27/04; B65D 27/06; B65D 27/34

[52] U.S. Cl. ..... 229/302; 229/303; 229/313

[58] Field of Search ..... 229/300, 301, 302, 303, 229/306, 309, 310, 311, 312, 313, 316

[56] References Cited

U.S. PATENT DOCUMENTS

| | | | |
|---|---|---|---|
| 570,557 | 11/1896 | Muenchinger | 229/307 |
| 1,463,442 | 7/1923 | Samuel | 229/313 |
| 1,575,769 | 3/1926 | Kaye | 229/303 |
| 3,086,695 | 4/1963 | Lillibridge | 229/303 |
| 4,308,987 | 1/1982 | Solomon | 229/302 |
| 5,025,980 | 6/1991 | Blackman | 229/302 |

FOREIGN PATENT DOCUMENTS

| | | | |
|---|---|---|---|
| 1386336 | 1/1962 | France | 229/309 |
| 2383083 | 10/1978 | France | 229/302 |
| 2394460 | 1/1979 | France | 229/313 |
| 0904238 | 8/1962 | United Kingdom | 229/309 |

*Primary Examiner*—Allan N. Shoap
*Assistant Examiner*—Jes F. Pascua
*Attorney, Agent, or Firm*—Klauber & Jackson

[57] ABSTRACT

A two way envelope having front and rear panels with respective integral closure flaps. The front panel is provided with a window for viewing the mailing address on the contents within the envelope. The closure flap, integrated with the rear panel, has a width only sufficient to cover the indicia of return address and postage on the front panel and is preprinted with such indicia as well as bar coding. The closure flap, integrated with the front panel, is provided with a dual perforated or serrated tear strip with a free finger-lift end, and to ensure stability and replicability of tearing, the tear strip is stiffened with a stiffening material, in particular an extension of the glue applied for sealing of the envelope. For postal bar encode window envelopes, an open slot is located at the bottom of the envelope to permit postal bar encoding and reading off the envelope contents both in the original mailing and return mailing phases. For dual envelope promotional contest type mailings a single non-window envelope with preprinted mailing address has a preprinted response on the front panel and a second alternate response on the rear panel integrated closure flap.

3 Claims, 2 Drawing Sheets

TWO WAY ENVELOPE FOR AUTOMATED INITIAL USE

Figure 1:
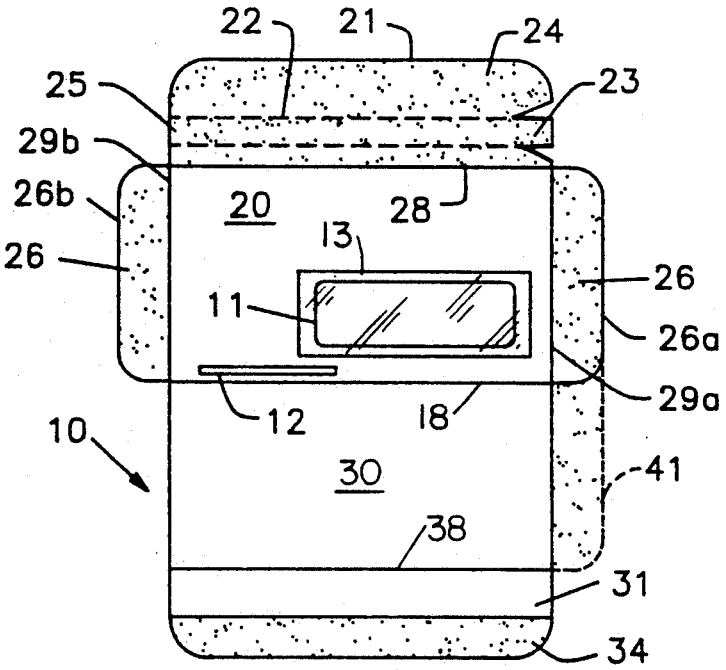

This invention relates to two way envelopes and particularly to those having narrow width closure flaps.

Two way envelopes, those envelopes designed for use by the recipient for a return reply have been in existence since at least the time of the Civil War (see for example U.S. Pat. No. 41,804). These envelopes provide the advantages of convenience, reduced cost and postage as well as the presently important environmental advantage of built-in recycling.

Various embodiments of the two way envelopes appear in the patent literature as well as in commercial use. Generally the envelope is provided with two closure flaps which are reversed on return. The face or front of the envelope has the initial indicia of return address and postage and the reverse closure flap, attached to the rear panel of the envelope, is either preprinted or has room for appropriate return indicia. The reverse closure flap is either of sufficient dimension to cover the original mailing address with the return address or, with the use of windowed envelopes, the reverse closure flap is of minimal width to only cover the initial return address and postage located in the upper portion of the envelope. The mailing address in windowed envelopes is simply changed by the insertion of contents with an exposed different address.

Patents disclosing examples of envelopes having the full size closure flap include U.S. Pat. Nos. 4,595,138 (Kristel); 4,332,346 (Kronman); 4,288,028 (Diaz); 4,308,987 (Solomon); and 4,565,317 (Kranz). Patents disclosing examples of envelopes having minimal width return flaps in conjunction with address windows include U.S. Pat. Nos. 3,558,040 (Krueger); 3,111,257 (Peach); 3,498,528 (Klein); and 3,512,702 (Pritchard, Jr.).

The problems addressed in many of the aforementioned patents, e.g., Krueger, include the prevention of mutilation of the envelope by the original addressee by use of manual letter openers or automatic envelope openers which would tend to sever the return flap together with opening of the envelope. Other patents, e.g. Kristel and Kronman, address the problem of preventing mutilation of the envelope by opening of an end, which renders the envelope unusable for return. Many two way envelopes are provided with specific tear lines and/or tear strips to direct the addressee to a specific non-mutilation type of opening. However, many times the addressee doesn,t realize the nature of the envelope until the envelope has been mutilated in the opening thereof.

In order to minimize mutilation by the addressee during use, some existing embodiments provide closure flaps on both sides which are of minimal dimension. A single window is used, with appropriate placement of the contents or enclosure exposing the proper address for mailing. The smaller flaps, which can only be used in one way, tend to avoid problems in handling by a person unfamiliar with the envelope, particularly since larger flaps must be folded several times and in various ways.

Problems still exist with two way envelopes particularly at the initial addressee opening stage. These problems include, as previously described, the mutilation of the envelope by the addressee before it is realized that the envelope is also a return envelope. Additionally, even if the original addressee opens the envelope by using the tear line or tear strip as directed, the thin inexpensive paper used in mass produced envelopes does not always lend itself to reliable tearing. Tear strips of thin material tend, at times, to tear in directions which mutilates the envelope, rendering it unusable. The original addressee is then forced to use a plain envelope for return. This however results in a detriment to the proper handling of the transaction.

Under the present postal system and with present technology, bar codes and optical scanners permit facilitation of mail handling and appropriate automated handling of return envelopes by mass mailers. These objectives are seriously affected by the large scale use of non-conforming envelopes by addressees who have mutilated the envelopes originally intended to be return envelopes with appropriate bar code indicia.

It is also a current postal practice to bar code encode mail (particularly those used for billing of utility use) at the bottom (within the bottom half inch) of the front of the envelope beneath the original address window (and offset to the right of center of the envelope). This encoding militates against the use of two way envelopes with small width flaps in which the window is used for both original and return addressing. The original encoding remains visible on the envelope, upon return, thereby either interfering with new encoding or detrimentally works to misdirect the return envelope back to the original addressee.

It is accordingly an object of the present invention to provide a two way envelope with narrow width dual flaps and a single addressing window wherein the envelope structure plainly indicates the means for opening.

It is further object of the present invention to provide such dual envelope structure wherein the opening thereof is economically made more reliable with reduction of addressee mutilation.

It is a still further object of the present invention to provide a two way envelope with narrow width dual flaps and a single addressing window wherein means are provided for permitting effective return envelope postal encoding.

It is a further object of the present invention to provide an envelope with dual flaps permitting exposure of alternate indicia on return as an external indication of an alternate selection.

Figure 2A:
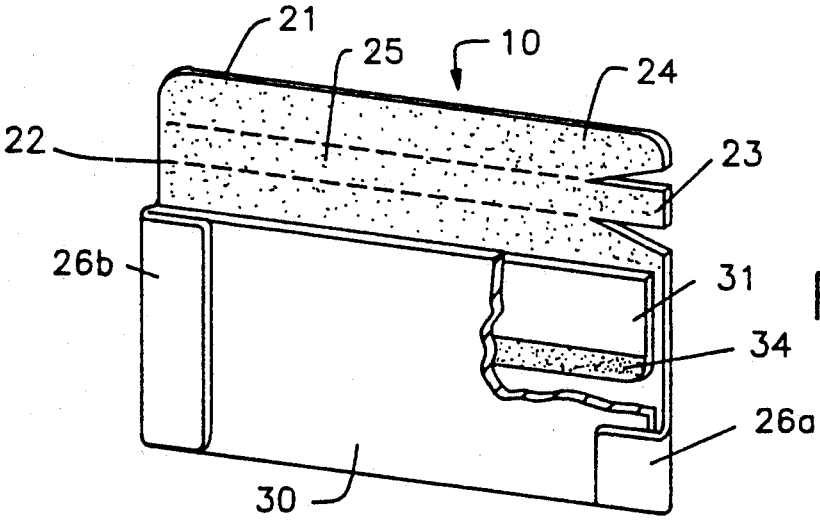
Figure 2B:
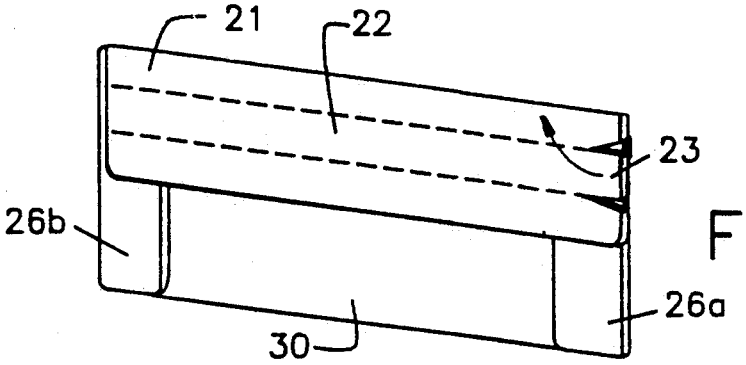
Figure 3A:
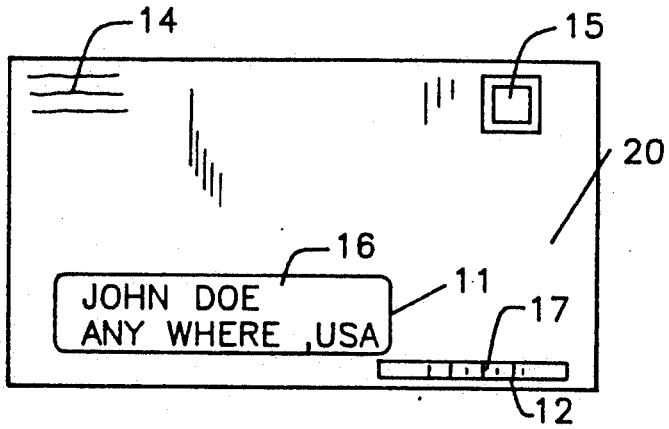
Figure 3B:
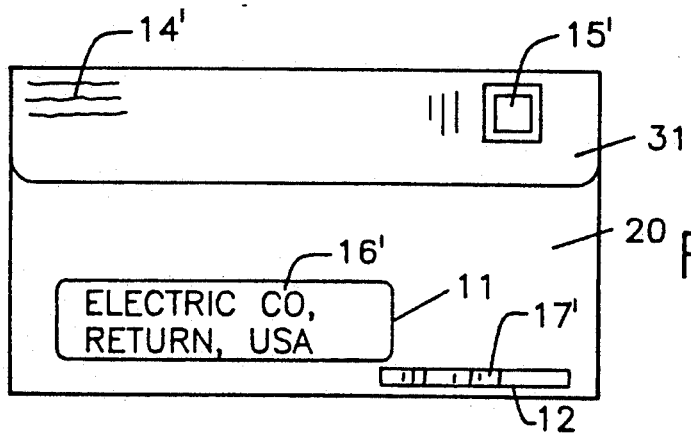
Figure 4:
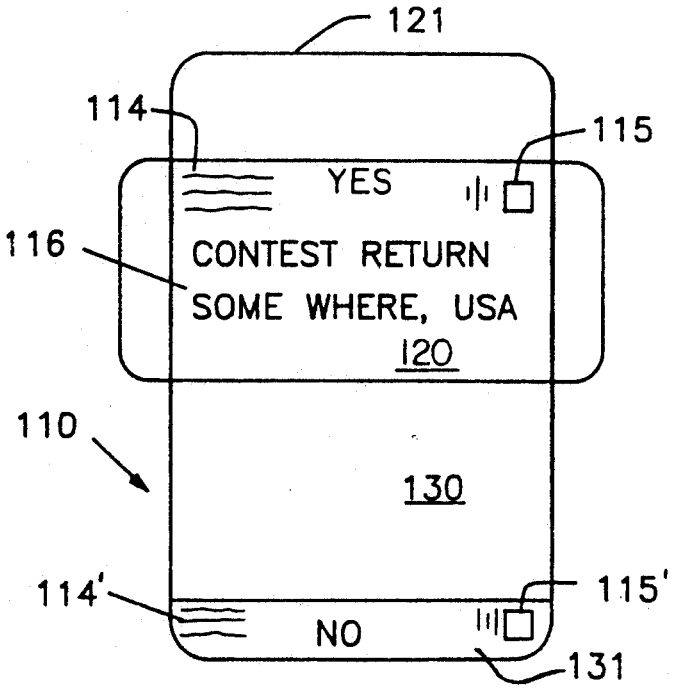

These and other objects, features and advantages of the present invention will become more apparent from the following discussion as well as the drawings in which:

FIG. 1 is a rear view of a blank of the envelope of the present invention;

FIG. 2*a* and 2*b* are rear views of the envelope as being folded for an original mailing and as being opened respectively;

FIGS. 3*a* and 3*b* are front views of the envelope as originally mailed and as returned respectively; and FIG. 4 is a blank of a second embodiment of the present invention with external alternative indicia for a single mailing return address.

Generally the present invention comprises a two way envelope formed from a single blank with integrated front and rear panels adapted to be peripherally attached to each other at two other sides to form an envelope receptacle. The distal ends of the front and rear panels have respective integral closure flaps with adhesive applied to the free ends of each of the closure flaps. The front panel is provided with a window (either open or covered with a transparent material such as cellophane) for viewing the contents within the envelope, which window is positioned below the standard position for indicia of return address and postage. The closure flap, integrated with the rear panel, has a width sufficient to cover the indicia of return address and postage but does not extend to cover any portion of the window when folded across the opening of the envelope receptacle. On initial use, the rear panel integrated closure flap is folded into the envelope and the front panel integrated closure flap is folded over the envelope receptacle opening and glued to the rear panel. With removal of the tear strip, the envelope is returned by folding the rear panel integrated closure (preprinted with return indicia for return address, postage and appropriate bar code) over the envelope receptacle opening and glued to the front panel.

In accordance with the present invention, the closure flap, integrated with the front panel, and separated therefrom by a fold line, is provided with a dual perforated or serrated tear strip with a free finger-lift end in the form of a tab which is separated from the flap for ready recognition and for ready insertion of a finger underneath. Additionally, in accordance with the present invention, to ensure stability and replicability of tearing, the tear strip itself is provided with stiffening means such as coating or an additional material layer on the tear strip.

Many of the tear strips of envelopes of the prior art are defined only by perforations and are difficult to notice and if noticed, difficult to utilize without deviation. In accordance with the present invention, at least one end of the tear strip is provided with the free finger lift tab which is readily noticeable by the recipient as the means required for proper opening. In addition, the free finger lift tab provides the initial guidance for the tear to begin in a proper direction in order to prevent improper tearing and mutilation.

With such embodiment, the free finger lift tab tends to leave a corner open for insertion of a manual letter opener to either cut open the top or side of the envelop. It is accordingly preferred that an extra extension be provided for the closure flap which initially seals the envelope to keep the letter opener (both manual and automatic) from severing the secondary flap used for the return mailing. In addition, it is preferred that the sides of the envelopes, adjacent the free finger lift tab, be provided with a secondary flap for use for sealing the envelope if the side of the envelope is opened with a manual letter opener.

The stiffening material should be present uniformly along the length of the entire tear strip and extend across both serration or perforation lines to ensure that the full tear strip be cleanly removed without accidental deviations across the serrations or perforations which define the tear strip. The stiffness imparted by the stiffening material should be sufficient whereby the tab and tear strip acquire a structural integrity relative to the envelope material sufficient to provide such clean removal without accidental deviations across the predetermined tear lines.

The stiffening material is either an economical and simple extension of the adhesive or glue material, on the closure flap integrated with the front panel, or is a separately applied stiffening material such as starch. The latter is preferred if the automated sealing machine used in originally sealing the envelope is not readily adjusted whereby it does not activate the glue on the tear strip. In such latter instance, the stiffening material should remain relatively unaffected by the activation of the glue, ie.e. should not provide adherence or significantly lose any imparted stiffness.

To provide the requisite stiffness, the stiffening material should be present in a thickness at least equivalent to the layer of glue used to seal the envelope but its thickness should not be excessive whereby it impedes such sealing.

In accordance with a further embodiment of the present invention, the envelope is provided with an open slot (no cellophane covering) beneath the window, which slot is positioned at the standard location of postal bar code encoding (within the bottom half inch of the front panel and offset to the right of the center). In this embodiment, the contents of the envelope are designed to present a blank printable background within the slot in both the original mailing and the return mailing. With reinsertion of the envelope contents with the return address showing through the window, either a blank space is exteriorly presented for additional postal encoding or a preprinted return address encoding is exteriorly presented.

In another embodiment of the present invention a single envelope is preprinted with a mailing address and is provided with dual flaps. The front panel and closure flap, integrated with the rear panel, both have indicia of postage and return address and are preprinted with a selected choice, e.g., YES or NO, as a readily obvious indication of the contents of the envelope for purposes of mass mailing surveys, promotional contests, and the like. If the front panel selection is to remain exposed, the closure flap, integrated with the front panel, is used to seal the envelope and if the closure flap selection is desired, the closure flap is used to seal the envelope, cover the front panel indicia of selection, and expose the selection thereon.

With specific reference to the drawings, as seen in FIG. 1, envelope blank 10 has front and rear panels 20 and 30 respectively which are integrated with each other at fold line 18. Front panel 20 is integrally provided with closure flap 21 at fold line 28 and rear panel 30 is integrally provided with closure flap 31 at fold line 38. Side flaps **26*a* and 26*b* are integrated with front panel 20 at fold lines 29*a* and 29*b* respectively. Closure flaps 21 and 31 are provided with adhesive or glue 24 and 34 respectively requiring activation for adhesion. Closure flap 21 is further provided with tear strip 22, with free finger lift tab end 23, and wherein tear strip 22 is stiffened with glue extension 25. Address window 11 in front panel is covered with cellophane layer 13 and bar code exposing slot 12 is an open uncovered slot in the lower portion of front panel 20**.

As shown in FIGS. **2*a* and 2*b* the finished envelope 10 is constructed by folding along the respective fold lines 18, 29*a* and 29*b* to bring the front and rear panels 20 and 30 together and to overlay and glue side flaps 26*a* and 26*b* to rear panel 30. In this regard it is noted that glue layer 26 may be positioned on the obverse sides of flaps 26*a* and 26*b* whereby such flaps are sandwiched between front and rear panels 20 and 30 when glued to rear panel 30**.

As shown in FIG. **2*a*, prior to insertion of the envelope contents and sealing, flap 31 is tucked into envelope 10 for later use. The envelope 10 is sealed as shown in FIG. 2*b* with glue 24 being activated for adhesion but not glue 25 on tear strip 22. The front of the envelope is shown in FIG. 3*a* with the mailing address visible through window Sender's return address 14 and postage 15 also appear on the upper portion of front panel 20. Open slot 12 permits the postal bar encoding of bar code 17** (recipient's address) on a blank portion of the contents of the envelope.

Upon receipt, and with reference to FIG. 2*b*, the recipient clearly detects free finger lift tab 23 as the means for opening the envelope and tear open tear strip 22 to open the envelope. Non-activated reinforcing or stiffening glue layer 25 on tear strip 22 causes the clean tearing thereof. Alternatively, to maintain envelope integrity if a letter opener is utilized to open the side of the envelope underneath the free finger lift tab 23, optionally provided integrated flap 41 (shown in phantom in FIG. 1) can be used to reseal an open end with the envelope being used as described.

For return, the recipient repositions the original contents of the envelope as shown in FIG. 3*b* to expose the return mailing address 16' through window 11 and at the same time a blank portion (or portion with preprinted bar code 17') of the contents appears through slot 12. Flap 31 with the indicia of return address 14' and postage 15' is pulled out of the envelope and glued to the face of front panel 20. If a blank space shows through slot 12, the post office can imprint the appropriate bar code address of the return recipient.

The envelope blank 110 shown in FIG. 4, is not a two way envelope but rather an envelope with alternative indicia shown on the front panel 120 thereof and on flap 131, both of which have identical return addresses 114 and 114' and postage indicia 115 and 115'. The returnee can seal the envelope with flap 121 with flap 131 either being tucked into the envelope or removed whereby the alternative on the front panel 120 is fully exposed. Alternatively, the returnee can tuck in or remove flap 121 and seal the envelope in the manner shown in FIG. 3*b* with flap 131 whereby the flap covers the original indicia with different indicia. In either event, preprinted mailing address 116 remains on the face of front panel 120. This embodiment is of utility with respect to promotional mailings or surveys whereby the envelope itself provides a highly visible indication of the contents for rapid handling and processing. At present two separate envelopes with different indicia are provided for this purpose.

It is understood that the above description and embodiments disclosed in the drawings are merely illustrative of the present invention. Changes may be made in the structure, configuration and components of the envelope elements without departing from the scope of the present invention as defined in the following claims.

What is claimed is:

1. A two way mailing envelope formed from a single blank with integrated front and rear panels adapted to be peripherally attached to each other to form the envelope with an open end for insertion of mailing material; said integrated front and rear panels each having an end distal to the other panel, wherein the distal ends of the front and rear panels each have respective integral closure flaps, with each flap having a free end, with adhesive applied to the free end of each of the closure flaps; with the front panel having a window for viewing a mailing address imprinted on said mailing material within the envelope, which window is positioned below the upper portion of the front panel which comprises a standard mailing position for indicia of return address and postage; wherein the closure flap, integrated with the rear panel, has a width sufficient to cover the indicia of return address and postage on said front panel, but does not extend to cover any portion of the window, when folded across the open end of the evelope; wherein the closure flap, integrated with the rear panel, is adapted, on initial mailing, to be folded into the envelope and the closure flap, integrated with the front panel, is adapted to be folded over the open end and glued to the rear panel; wherein the closure flap, integrated with the front panel, comprises a tear strip along its length, defined by two parallel perforated or serrated lines, whereby the tearing thereof exposes said open end for removal of the material contained within said envelope; the improvement comprising a free finger-lift tab on at least one end of said tear strip and wherein the tear strip is provided with stiffening means uniformly positioned along the length of the entire tear strip and overlying across both parallel perforated or serrated lines, whereby said stiffening means ensures that the full tear strip is cleanly removed without significant accidental deviations across the serrations or perforations which define the tear strip.

2. The two way mailing envelope of claim 1, wherein said stiffening means comprises an extension of the adhesive on the closure flap, integral with said front panel, and wherein the adhesive comprising said stiffening means is not activated for adhesion.

3. The two way mailing envelope of claim 1, wherein said stiffening means comprises a starch layer.

* * * * *